US006675971B2

(12) United States Patent
Case

(10) Patent No.: US 6,675,971 B2
(45) Date of Patent: Jan. 13, 2004

(54) COMPOSITE CONTAINER HAVING DETACHABLE LINER AND METHOD FOR MAKING CONTAINER

(75) Inventor: Manson Drew Case, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/270,891

(22) Filed: Oct. 15, 2002

(65) Prior Publication Data

US 2003/0038170 A1 Feb. 27, 2003

Related U.S. Application Data

(62) Division of application No. 09/559,170, filed on Apr. 26, 2000, now Pat. No. 6,510,674.

(51) Int. Cl.[7] ..... B65D 81/20

(52) U.S. Cl. ..... 206/524.8; 229/4.5; 229/164.2

(58) Field of Search ..... 206/524.8, 829, 206/303, 524.1, 524.2, 524.3, 497, 583; 229/164.1, 164.2, 4.5, 117.27, 117.3, 117.33–117.35; 426/404, 411

(56) References Cited

U.S. PATENT DOCUMENTS

| | | | | |
|---|---|---|---|---|
| 2,623,680 A | | 12/1952 | Wilcox | |
| 2,771,184 A | * | 11/1956 | Ryno et al. | 229/4.5 |
| 3,083,889 A | * | 4/1963 | Christensson | 206/524.8 |
| 3,981,433 A | * | 9/1976 | Thornhill et al. | 229/4.5 |
| 4,117,182 A | | 9/1978 | Andrews | |
| 4,158,425 A | | 6/1979 | Sansbury | |
| 4,267,928 A | | 5/1981 | Curry, Jr. | |
| 4,282,984 A | * | 8/1981 | Curry, Jr. | 229/164.1 |
| 4,295,840 A | | 10/1981 | Sansbury | |
| 4,459,793 A | | 7/1984 | Zenger | |
| 4,734,292 A | | 3/1988 | Van Boxtel | |
| 4,911,938 A | | 3/1990 | Fisher et al. | |
| 4,925,684 A | | 5/1990 | Simon | |
| 4,937,113 A | | 6/1990 | Engelsberger | |
| 5,829,669 A | | 11/1998 | Drummond et al. | |
| 5,971,259 A | | 10/1999 | Bacon | |
| 5,988,493 A | * | 11/1999 | Clougherty | 229/164.2 |

FOREIGN PATENT DOCUMENTS

| | | |
|---|---|---|
| EP | 0 857 568 A2 | 8/1998 |
| EP | 0 949 152 A1 | 10/1999 |

* cited by examiner

*Primary Examiner*—Luan K. Bui
(74) *Attorney, Agent, or Firm*—Alston & Bird LLP

(57) ABSTRACT

A composite container having a detachable liner and a method for making the container are provided according to the present invention. The method includes providing a tubular body ply formed of a paperboard material and adhering the liner ply using a standard adhesive applicator. The method also includes heating a heat-releasable adhesive disposed between the liner ply and the body ply such that the liner ply substantially releases from the body ply. The liner ply remains adhered to the opposed ends of the container, thus providing a free medial portion between the opposed ends that can move inwardly if a negative pressure is created within the sealed container, thus equalizing the pressure within the container with that outside the container.

4 Claims, 3 Drawing Sheets

COMPOSITE CONTAINER HAVING DETACHABLE LINER AND METHOD FOR MAKING CONTAINER

CROSS-REFERENCE TO RELATED APPLICATION

This application is a divisional of U.S. application Ser. No. 09/559,170, filed Apr. 26, 2000, U.S. Pat. No. 6,510,674 which is hereby incorporated herein in its entirely by reference.

FIELD OF THE INVENTION

The present invention relates to composite containers, and in particular relates to composite containers having releasable liners applied to the inner surface thereof.

BACKGROUND OF THE INVENTION

Food and drink products and other perishable items are often packaged in tubular containers that are sealed at both ends. In the packaging of such perishable food products, a container is required that is rigid enough to retain its shape when subjected to reduced internal pressure created in the container while tightly sealing the food product to protect against deterioration, leakage, and contamination. Substantial economies, as well as environmental advantages, can be effected by the use of composite containers, as opposed to the traditional glass and metal containers. Composite containers typically comprise at least one body ply made from paper or other material that provides the main support for the container. The body ply may be formed by wrapping a continuous strip of the body ply material around a mandrel or passing the body ply material through a series of forming elements so as to wrap the material in a convolute shape around the mandrel. The tube is then cut into predetermined lengths at a downstream end of the mandrel and fitted with end closures to complete the container.

For hermetically sealing the container, a liquid impermeable liner ply is often adhered to the inner surface of the paperboard body ply. The liner ply seals the food product within the container and also prevents liquids, which may possibly contaminate the food product, from entering the container. Some liner plies are also gas impermeable, so as to not only prevent food product odors from escaping the can, but also prevent atmospheric air from entering the container and spoiling the food product. Thus, while the purpose of the body ply is to provide necessary structural properties to the container, the liner ply provides barrier properties necessary to protect and maintain the food product.

In addition, a label ply is typically included and adhered to the outer surface of the paperboard body ply. The label ply, which is typically a paper-based material, is a source of information that conveys product information, instructions, and regulatory compliance information. The label is also preferably decorative and aesthetically pleasing to the consumer, which enhances shelf appeal and increases consumer interest in the food product.

Certain food products create a vacuum within the container that occurs due to processing conditions. In particular, products that are deposited within the container that have a temperature greater than that of the room temperature will create a slight vacuum once the ends are placed on the container and the temperature of the products decreases to that of the room temperature. For example, relatively hot potato crisps can be deposited within the container and then sealed within the container by an end closure. As a result, hot air is trapped within the container. As the temperature of the air in the container decreases, the volume of the air decreases as well. Thus, a slight vacuum is formed within the container. Because of the structural design of the composite container, the application of vacuum to the interior of the container can introduce excessive stress to the paperboard body ply of the container, which often results in partial or complete inward collapsing of the container walls along the length of the container. This can result in an unacceptable appearance for the composite container or an unacceptable sealing of the product within the container. This problem can be further exacerbated if containers packaged at a certain elevation are then shipped to a lower elevation (and thus lower ambient air pressure) which further increases the pressure differential between the inside and outside of the containers.

U.S. Pat. No. 4,158,425, herein incorporated by reference, discusses problems associated with vacuum packaging food products in composite containers. To avoid the partial or complete collapsing of the paperboard body ply of the container upon the creation of the vacuum inside the container, the container according to the '425 patent has an impermeable or hermetically sealed liner secured interiorly to the container body solely at the opposed ends thereof with the major length of the liner being free of the tubular body so as to allow an inward contracting of the liner without the introduction of excessive stresses to the container body itself. A vacuum or reduced pressure atmosphere within the liner causes an inward deformation of the liner into contact with the product substantially independently of the surrounding container body. Thus, the stresses which are transferred to the container body are at the opposed ends thereof, which are in turn rigidified by a pair of conventional end caps.

The '425 patent, however, requires that the adhesive between the liner ply and the paperboard body ply be applied by a special adhesive applicator having a unique spiral design such that the adhesive is applied only at the respective ends of the composite container. By using the spiral design adhesive applicator, complexity is added to the production process as well as limiting the types of tubular composite containers that can be processed using that particular adhesive applicator. Although the '425 patent provides an inwardly moving liner, it is desirable to provide an inwardly moving liner using conventional manufacturing techniques, such as standard roll adhesive applicators.

Moreover, composite containers that are designed for use with products subjected to a rapid vacuum application during processing may still place excessive stresses on the body ply because the vacuum application can create a vacuum between the liner and body ply as the liner ply is drawn inwardly. In this regard, many composite containers require a vent hole in the body ply for allowing the rapid passage of air between the unadhered portions of the liner ply and the body ply, which adds complexity to the manufacturing process.

Accordingly, there is a need in the industry for a container that hermetically seals food products, but that can be made using standard manufacturing techniques. At the same time, however, such a container would also be robust such that the container is capable of withstanding the rigors of packaging, shipping and storing products that create a vacuum within the container.

SUMMARY OF THE INVENTION

The composite container of the present invention balances the need for ease of manufacturing with the strength necessary to maintain a hermetic seal as the vacuum is created within the container by providing a flexible liner that is adhered to an adjacent tubular body wall using standard application techniques, but is capable of substantially releasing from the adjacent tubular body wall when the container is heated to a threshold temperature for a predetermined time interval. Thus, the released portion of the liner ply is free to move inwardly toward products contained therein. The flexible liner, which has at least one layer comprising a polymeric material, is adhered initially to the tubular body wall along the entire length of the container. When the container is heated, however, the adhesive begins to lose its adhesive ability. Also during the heating process, the polymeric material of the liner ply contracts, thus causing the liner to substantially withdraw from the tubular body wall. As such, the tubular composite container of the present invention requires no special adhesive application, which would otherwise add cost and complexity to the manufacturing process.

In particular, the composite container of the present invention comprises a tubular body wall having opposed ends and inner and outer surfaces. The flexible liner comprises an outer layer having inner and outer surfaces, wherein the outer surface of the outer layer is releasably adhered to the inner surface of the tubular body wall using a heat-releasable adhesive. The flexible liner also includes an inner layer adhered to the outer layer which is formed of a polymeric material that contracts upon being heated. In one advantageous embodiment, the inner layer comprises a polyethylene film. When the container is heated to the threshold temperature for the predetermined time interval, the liner substantially releases from the tubular body wall and is free to move inwardly towards any products that may be contained therein thus providing not only a hermetic seal but also support to the products. In this manner, if a vacuum is created by the products deposited within the container, the vacuum does not act directly on the tubular body wall, thus preventing inadvertent collapse of the body wall. Instead, the liner ply moves inwardly to substantially equalize the pressures on either side of the liner ply. When the container is opened, the liner can be moved away from the products such that the products may be removed. A label surrounds the outer surface of the body wall.

Associated methods also form a part of the invention and, according to one embodiment, include the steps of providing a tubular body wall formed of a paperboard material having opposed ends and a flexible liner adjacent an inner surface of the tubular body wall, closing one end of the tubular body wall, and heating the tubular body wall and the liner such that the liner substantially releases from the tubular body wall. In one embodiment, food products having a temperature greater than room temperature can be deposited within the flexible liner and the open end of the container can then be closed with an end closure. As the products deposited within the liner ply cool to the surrounding temperature, a negative pressure is created within the liner such that the liner is moved inwardly away from the inner surface of the tubular body wall and toward the food products. In another embodiment, the products can be deposited within the container before the heating step that causes the liner to substantially release from the tubular body wall.

Accordingly, and as is explained in more detail below, the present invention provides a new container capable of withstanding a negative pressure created therein which overcomes the disadvantages of conventional methods and containers, namely requiring special patterning of the adhesive between the liner ply and the tubular body ply. The present invention is particularly advantageous for food products that are deposited within the container at an elevated temperature, such as roasted peanuts or potato crisps. The new container is easy to manufacture, and can use conventional adhesive applicators and techniques. At the same time, however, the present container is capable of withstanding negative pressure created within the container so as to maintain a rigid shape, and provide a hermetically sealed container to prevent air and moisture from contaminating the products contained therein.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
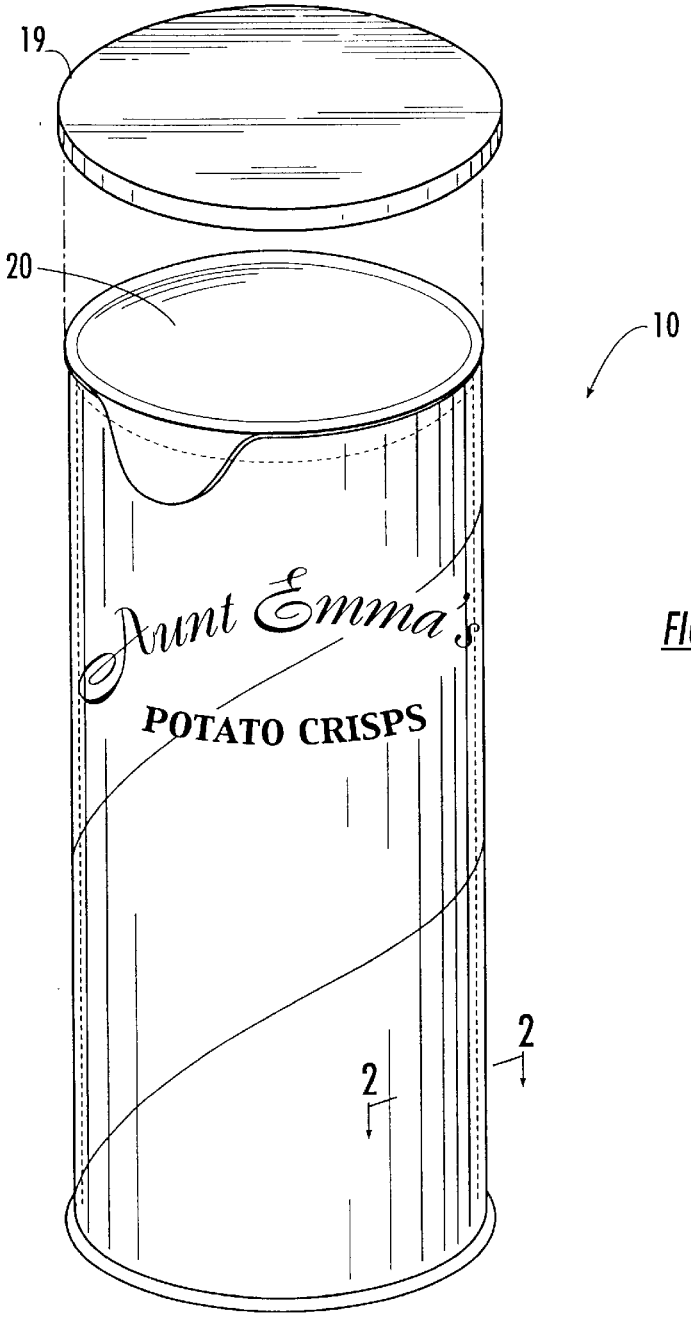
FIG. 1 is a perspective view of a container according to one embodiment of the present invention.
Figure 2:
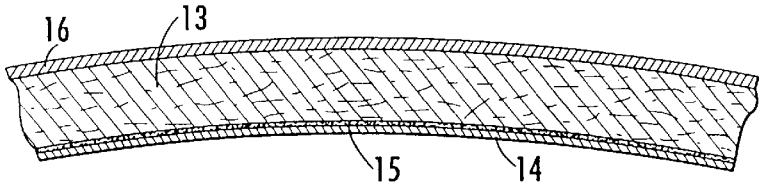
FIG. 2 is a cross-sectional view of the container of the present invention as seen along lines 2—2 of FIG. 1 shortly before the heating step.
Figure 3:
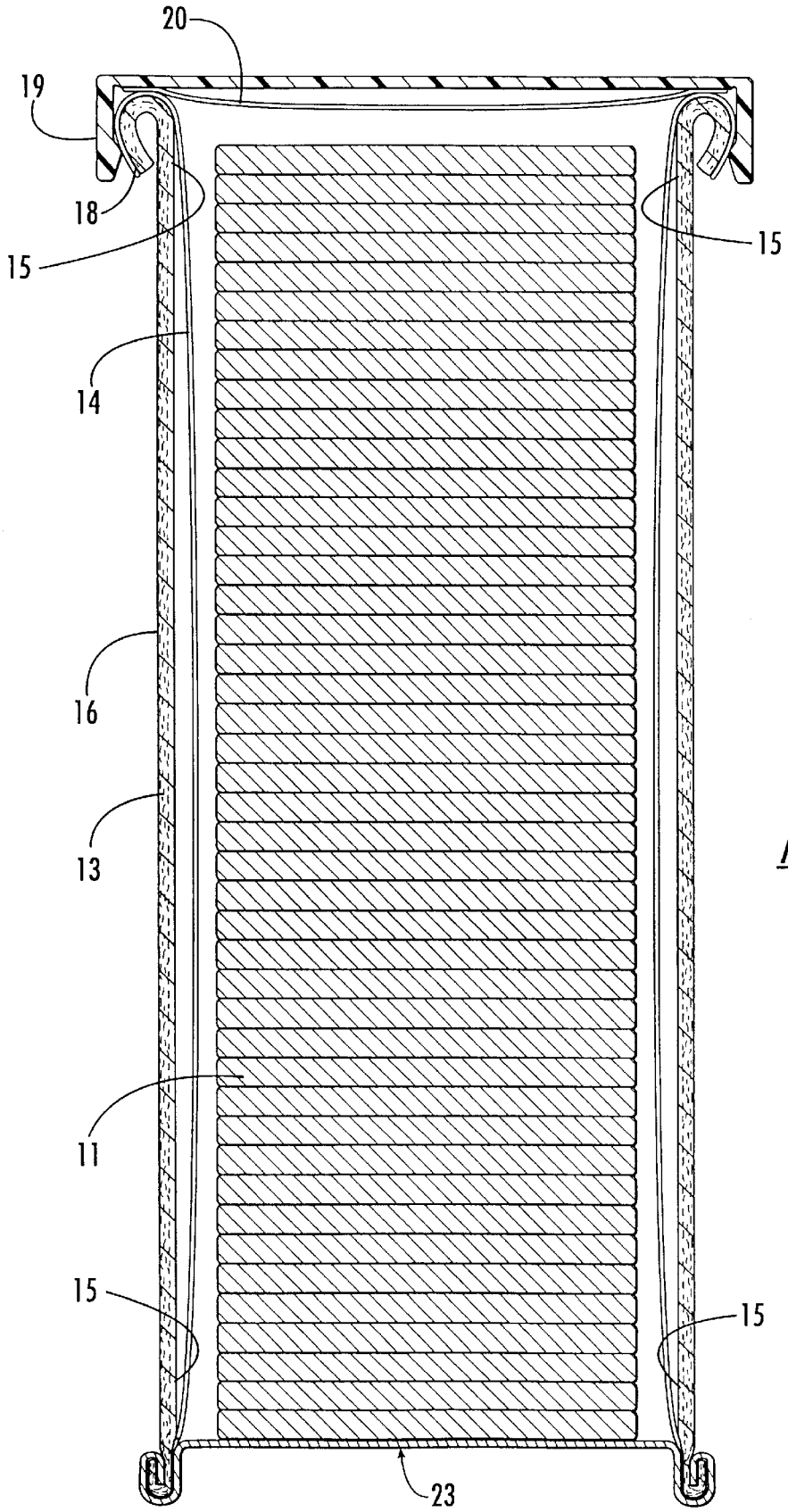
FIG. 3 is a sectional view of a portion of the container having the liner ply according to the present invention.

Turning first to FIGS. 1–3, a tubular container 10 is illustrated and is particularly advantageous for packaging food products 11, such as potato crisps or peanuts. Although illustrated as having a circular cross section, the tube of the container 10 may have any cross sectional shape that can be formed by wrapping the tube around an appropriately shaped mandrel. One example is a generally rectangular shaped tube having rounded comers. As illustrated in more detail in FIGS. 2–3, the tubular container 10 includes a body wall comprising at least one tubular body wall or ply 13 that is preferably formed of a strip of paperboard.

The body ply 13 may be advantageously composed of conventional spiral-winding paperboard having a thickness of about 0.15–0.30 inch. Such a body ply 13 is described in U.S. Pat. No. 5,988,493, which is herein incorporated by reference.

The tubular container 10 also includes a liner ply 14 comprising a polymeric material and adhered to the inner surface of the body ply 13. In particular, the liner ply 14 is constructed of multiple layers. In a preferred embodiment, the liner ply 14 includes an outer layer, such as a kraft paper, having inner and outer surfaces, wherein the outer surface of the outer layer is releasably adhered to the inner surface of the body ply 13 by an adhesive layer 15, as discussed more fully below. A foil layer provides barrier properties. The liner ply 14 also includes an inner layer which is formed of a polymeric material that contracts upon being heated. Liner plies such as described in U.S. Pat. No. 5,829,669, which is herein incorporated by reference, may also be used.

As mentioned above, the adhesive layer 14 is initially secured to the body ply 13 by the adhesive layer 15. In one embodiment, the adhesive layer 15 comprises a polyvinyl material, although other materials may also be used, as discussed more fully below. Advantageously, the adhesive layer 15 is applied to the entire inner surface of the body ply 13, such that no special machine components are required for applying the adhesive layer 15 in a pattern configuration.

Advantageously, the adhesive layer 15 is adapted for substantially losing its ability to adhere when heated to a threshold temperature for a predetermined time interval, which allows the liner ply 14 to release from the body ply 13. In one embodiment, subjecting the adhesive layer 15 to a temperature of about 130° F.–170° F., and preferably about 150° F., for about 30–90 seconds, and preferably about 60 seconds, causes the adhesive layer to substantially lose its adhesive ability. Advantageously, however, the manufacturing process according to the present invention prevents the liner ply 14 from completely releasing from the body ply 13, as discussed more fully below.

In one embodiment, the tubular container 10 of the present invention also includes a flexible end closure 20 (sometimes referred to as a "membrane") that is affixed to an end of the tubular container 10. The other end closure of the tubular container 10 may be constructed of steel or aluminum plate with applied coatings and/or electrolytic tinplate. The flexible end closure 20 is preferably made of a flexible laminate made of films, kraft paper, foil, and/or extruded polymers and is heat sealed or adhesively attached to the end of the tubular container 10.

In particular, the flexible end closure 20 includes a barrier layer that serves as a barrier to the passage of liquids and/or gasses such as oxygen. If a barrier is required for both liquids and gasses, the barrier material is preferably selected from the group consisting of metal foil, such as aluminum foil, polyethylene terephthalate, modified polyethylene terephthalate, polyethylene napthalate, polyamide, metallized and silicate coated polyester, metallized and silicate coated polypropylene, metallized polyamide, polyvinylidiene chloride, ethylene vinyl alcohol, and mixtures thereof. Other layers may be disposed on the outermost surface of the flexible end closure 20 away from the inside of the tubular container 10, including paper or paperboard layers, such as a kraft paper layer.

An alternative end closure that can be used comprises a steel or aluminum flanged rim with applied coatings and/or electrolytic tinplate with a center panel of a flexible laminate made of films, foil, and/or extruded polymers and having a tab extending therefrom for grasping by the consumer. Such an end closure is sold under the trademark ULTRASEAL® and is available from Sonoco Products Company.

In one embodiment, a label ply 16 is adhered to the outer surface of the body ply 13. The label ply 16 is conventionally constructed from materials known in the art, such as kraft paper in combination with various polymers or the like. In addition, a cap 19 may be secured to an end of the container 10.

FIG. 3 shows a sectional view of the tubular container 10 wherein the liner ply 14 is substantially released from the body ply 13. More specifically, the axially opposed end portions of the liner ply 14 remain adhered to the inner surface of the body ply 13, but are separated by a medial portion of the liner ply 14 disposed between the axially opposed end portions that is free and unadhered to the body ply 13. Accordingly, after the food products 11 have been placed inside the cavity defined by the liner ply 14, the liner ply is free to move inwardly against the food products 11 when a vacuum is created therein thus balancing the pressure on the inner and outer surfaces of the liner ply.

The container 10 of the present invention is particularly advantageous for food products that are packed at elevated temperatures, such as about 160° F.–180° F., and more particularly about 170° F. In particular, food products that are packed at such temperatures heat the air surrounding the food products to a similar elevated temperature inside the container. When the container is sealed while the food products are still at the elevated temperature, the heated air is trapped within the container. As the temperature of the food products and the trapped air inside the container cools over time, the volume of the trapped air decreases accordingly, which creates a vacuum or negative pressure that could cause the body ply to implode. However, the tubular composite container 10 of the present invention is capable of neutralizing the negative pressure created within the liner ply 14 such that the pressure inside the liner ply is substantially equal to the pressure outside the liner ply. In this regard, the liner ply 14 is capable of moving toward the food products 11 in order to decrease the volume defined by the liner ply and thus equalize the pressures on each side of the liner ply. In addition, the flexible end closure 20 may also move inwardly toward the food products to help reduce the volume inside the container. Once the liner ply has moved inwardly, the stiffness of the liner ply may at least partially absorb any impact forces on the food products 11 caused by jostling of the container 10, which can prevent the food products from breaking.

Furthermore, no vent hole is required in the body ply 13. More specifically, the negative pressure created by the food products 11 is formed slowly compared to a conventional vacuum sealing operation, which is quite rapid. Thus, air is allowed to naturally migrate through the paperboard body ply 13 into the space created between the liner ply 14 and the body ply 13 as the liner ply moves inwardly toward the food products.

Figures 4, 5:
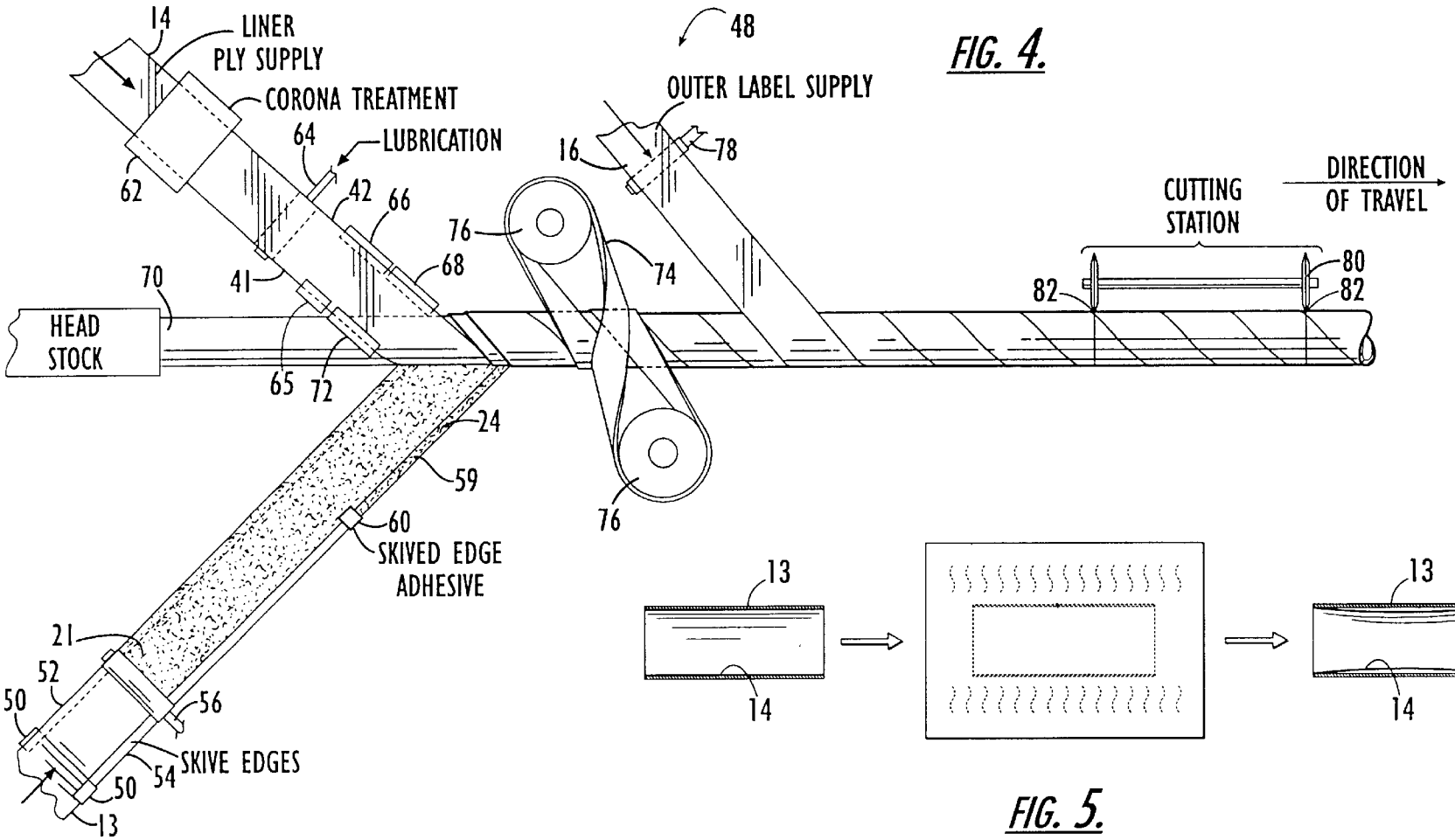
FIG. 4 is a view of an embodiment of an apparatus for making a tubular container according to the present invention.
FIG. 5 is a schematic view showing the heating step of the present invention.

The container 10 of the present invention may be manufactured by the process illustrated in FIGS. 4–5. As shown, a continuous strip of paperboard body ply material 13 is supplied to the apparatus 48 and is first passed through a pair of opposed edge skivers 50. The edge skivers remove part of the square edge of the body ply 13 to create first 52 and second 54 edges having a beveled configuration. The body ply 13 is then advanced through an adhesive applicator 56, which applies an adhesive 21 to the inner surface of the body ply 13. Advantageously, the adhesive applicator 56 can be a standard roller type applicator that applies adhesive to the entire inner surface of the body ply 13, thus eliminating the time and expense associated with changing to an adhesive applicator having a special pattern. The adhesive 21 is advantageously an aqueous adhesive, which overcomes the many problems associated with solvent-based adhesives. No special equipment is needed to capture solvents that evaporate from the adhesive in order to comply with environmental regulations.

The body ply 13 and wet adhesive layer 15 applied thereto may then be passed underneath a heater (not shown) which evaporates at least part of the water content of the aqueous adhesive 21 to render the adhesive substantially tacky. It is important that the correct amount of heat is supplied to the adhesive. Insufficient heat will not evaporate enough water in a sufficiently short period of time with the result that the adhesive will not be rendered sufficiently tacky. Conversely, too much heat will overdry the adhesive and cause the adhesive to lose tackiness. A preferred type of heat source is an infrared heater although various other heat sources, e.g., forced air heating or the like can be used.

After heating the adhesive layer 15 on the body ply 13, the body ply 13 and the liner ply 14 are fed to the shaping mandrel 70 from opposite directions. The body ply 13 is passed under skive adhesive applicator 60 which applies the skive adhesive 59 to the beveled surface of the skived second edge 54 of the body ply 13.

In one advantageous embodiment, the surface of the liner ply that contacts the body ply 13 is subjected to a corona treatment station 62. The opposite surface of liner ply 14 is coated with lubricant from a roller 64, which allows the liner ply to slide smoothly during the winding operation. The liner ply 14 is then passed through an edge folder 65, which folds over the first marginal edge portion 41 to create an anaconda fold in the liner ply, and adjacent to an infrared heater 66, which heats the second marginal edge portion 42 of the liner ply. After the infrared heater 66, the second marginal edge portion 42 of the liner ply 14 is then passed adjacent to at least one forced air heater 68.

The body ply 13 and the liner ply 14 are then wrapped around the shaping mandrel 70 from opposite sides of the mandrel. Each ply is first wrapped under the mandrel 70 and then back over the top in a helical fashion with the liner ply 14 wound against the surface of the mandrel. The first marginal edge portion 41 of the liner ply 14 is exposed on the mandrel 70 and is subjected to heat from a second forced air heater 72.

As the body ply 13 is further wrapped and the first edge 52 of the body ply 13 advances back under the mandrel 70 after one complete revolution, it is brought into contact with the second edge 54 of the ensuing portion of the body ply 13 which is first coming into contact with the mandrel. The skived edges 52, 54 become overlapped and the skive adhesive 59 adheres the edges together to form a spirally wound tube which advances along the mandrel 70.

With regard to the liner ply 14, the first marginal edge portion 41 is brought into an overlapping relationship with the second marginal edge portion 42 to create a sealed anaconda seam. The seal is formed by polymeric seal layers of the first and second marginal edges 41, 42 becoming bonded to each other. However, a strip of hot melt adhesive or other adhesives and methods could alternatively be used for securing and sealing the liner overlap.

The tube is then advanced down the mandrel 70 by a conventional winding belt 74, which extends around a pair of opposed pulleys 76. The winding belt 74 not only rotates and advances the tube, but also applies pressure to the overlapping edges of the body ply 13 and liner ply 14 to ensure a secure bond between the respective ply edges.

An outer label ply 16 is then preferably passed over an adhesive applicator 78 and wrapped around the body ply 13. The label ply 16 could be applied before the winding belt 74. At a cutting station 80, the continuous tube is cut into discrete lengths before being removed from the mandrel 70. In one embodiment, the cutting station 80 includes a circular cutting blade that mechanically cuts through the label ply 16, body ply 13, and liner ply 14 at end points 82. In this regard, a normal force is created on the container 10 by the cutting blade that is directed radially inward against the container. Accordingly, the mandrel 70 provides an opposing force against the inside of the container 10.

Although not wishing to be bound by theory, it is the belief of the applicant that these forces generated by the cutting operation cause the liner ply 14 and the body ply 13 to form a strong mechanical bond therebetween, such that the liner ply resists releasing from the body ply 13 when the adhesive layer 15 is heated to the threshold temperature for the predetermined time interval, as discussed more fully below. This bond is stronger than the bond formed between the remainder of the liner ply and the body ply, which was not directly subjected to the cutting forces. As such, the liner ply 14 remains adhered to the body ply 13 in localized areas adjacent to end points 82 after the medial portion of the liner ply releases from the body ply when the adhesive layer 15 is heated to the threshold temperature for the predetermined time interval. In one embodiment, the localized areas extend about 1/16–1/8 inch along the length of the container 10 from the end points 82.

As mentioned above, the tube is subjected to heat in order to substantially release the liner ply 14 from the body ply 13. In one embodiment shown in FIG. 5, the tube is placed in a heating device 90, such as a hot air heater, having an operating temperature of about 130–170° F., and preferably about 150° F. Other types of heating devices can also be used, such as an infrared or microwave heater. As shown in FIG. 5, the liner ply 14 is adhered to the body ply 13 prior to engagement with the heating device 90. When the tube is placed in the heating device and subjected to the operating temperature, i.e., the threshold temperature, for a predetermined time, such as about 30–90 seconds, and preferably about 60 seconds, the adhesive layer 15 loses its ability to adhere such that the liner ply 14 is capable of withdrawing somewhat from the body ply 13. In this regard, it is the belief of the applicant that the polymeric layer of the liner ply 14 contracts during the heating step, thus causing the kraft paper outer layer of the liner ply to withdraw from the body ply 13. In one embodiment, the liner ply 14 withdraws about 1/16–1/8 inch away from the body ply 13. However, it would be appreciated that it is not necessary for achieving the benefits of the invention that the liner ply 14 actually withdraw from the body ply 13 when heated, only that the adhesive bond therebetween be weakened to allow subsequent withdrawal when the container is closed. As discussed above, however, the liner ply 14 typically remains adhered to the body ply in the localized areas adjacent end points 82.

In one embodiment, the end closures are then attached to the ends of the tube. At least one of the ends of the container 10 is rolled outwardly to form a rim 18 which provides a suitable surface for affixing the flexible end closure 20. Another end closure, such as a metal closure, is attached to the other end of the container 10. In another embodiment, the metal end closure is applied to one end of the container 10 prior to filling of the container with the food products 11. A preferred metal end closure is disclosed in U.S. Pat. No. 5,971,259, which is assigned to the assignee of the present invention and herein incorporated by reference.

After filling with food products 11, such as food products having an elevated temperature, another end closure is applied to the opposing end of the tubular body. As described above, heated air is trapped inside the volume defined by the liner ply 14 and the end closures. As the air cools, a negative pressure is created therein because the volume of the cooler air is less than the volume of the heated air. Advantageously, the released medial portion of the liner ply 14 moves inwardly towards the food products 11 to reduce the volume such that the pressure is equalized across the liner ply. A similar movement of the liner ply 14 occurs when a sealed container is shipped to a lower elevation and the ambient pressure surrounding the container increases. Advantageously, the liner ply 14 is also free to move back towards the body ply 13 if the container is thereafter shipped to a higher elevation and thereby reduce any risk of overpressurization of the container.

As the liner ply 14 moves inwardly, a space develops between the liner ply and the body ply 13. The relatively porous paperboard construction of the body ply 13, however, allows for a sufficient migration of air to travel therethrough such that the space between the liner ply and the body ply remains at atmospheric or ambient pressure. Thus, the body ply 13 is not subjected to negative pressure over an extended period, which could cause the container 10 to collapse.

When the container 10 is opened by the consumer, such as by removing the flexible end closure 20, the liner ply 14 may withdraw somewhat from the food products 11 due to the weight of the food products. This withdrawal of the liner ply 14 helps in removal of the food products from the container 10.

Although the heating step has been described as occurring after the tube has been cut and before the food products 11 have been placed inside the container 10, the heating step alternatively could occur at various other times. For example, in one alternative embodiment the heating step occurs after one end closure, such as the flexible end closure 20, has been secured to one end of the container 10. In another alternative embodiment, the heating step occurs after the food products 11 have been placed in the container and after both end closures have been secured to the container.

Thus, the present invention provides a method of manufacturing a composite container 10 having a detachable liner 14 that overcomes the disadvantages of conventional methods and containers. In particular, the container 10 can be manufactured using mostly standard techniques and does not require special adhesive applicators to apply the adhesive layer 15 in a patterned configuration, which adds changeover time and additional expense to the standard manufacturing process. Thus, the container 10 of the present invention is particularly advantageous for packaging food products 11 having an elevated temperature, which upon cooling naturally create a negative pressure inside the sealed container. Following the method of the present invention allows the liner ply 14 to substantially release from the body ply 13 and move freely inwardly toward the food products. The tubular body ply 13 allows air to travel to the space created between the liner ply and the body ply, such that the pressures on each side of the liner ply are balanced when the temperature of the food products is at or near room temperature. The new container 10 is easy to manufacture, yet is capable of withstanding a rigid shape and providing a hermetic seal to prevent air and moisture from contaminating the products contained therein.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products where a heat releasable liner ply is advantageous, including products other than food which may be packaged at an elevated temperature or shipped to lower elevations. Although specific terms are employed herein, they are used in a generic and descriptive sense only and not for purposes of limitation.

That which is claimed:

1. A tubular composite container for products, comprising:

a tubular body wall formed of paperboard material having inner and outer surfaces and opposed ends;

an adhesive layer applied to substantially all of the inner surface of the tubular body wall between the opposed ends least one product sealed within the tubular composite container; and a flexible liner ply adhered to said opposed ends of said tubular body wall and having a loose medial portion not adhered to the inner surface of said tubular body wall and comprising a polymeric material capable of being contracted upon being heated at a threshold temperature for a predetermined time interval, wherein said at least one product is stored within said flexible liner ply, and wherein pressure within said flexible liner ply is substantially equal to ambient pressure.

2. A tubular composite container according to claim 1, wherein said flexible liner is drawn away from said tubular body wall.

3. A tubular composite container according to claim 1, wherein the polymeric material comprises polyethylene film.

4. A tubular composite container according to claim 3, wherein said polyethylene film is laminated to a kraft paper layer.

* * * * *